US005295546A

United States Patent [19]

Giannesini et al.

[11] Patent Number: 5,295,546

[45] Date of Patent: Mar. 22, 1994

[54] INSTALLATION AND METHOD FOR THE OFFSHORE EXPLOITATION OF SMALL FIELDS

[75] Inventors: Jean-Francois Giannesini, Saint-Cloud; Jean Falcimaigne, Bois-Colombes, both of France

[73] Assignee: Institut Francais Du Petrole, Rueil-Malmaison, France

[21] Appl. No.: 87,411

[22] Filed: Jul. 8, 1993

Related U.S. Application Data

[63] Continuation of Ser. No. 743,762, Aug. 12, 1991, Pat. No. 5,226,482.

[30] Foreign Application Priority Data

Aug. 10, 1990 [FR] France ..... 10 273
Apr. 4, 1991 [FR] France ..... 04 223

[51] Int. Cl.[5] ..... E21B 43/01; E21B 43/017

[52] U.S. Cl. ..... 166/353; 166/354; 166/355; 166/366

[58] Field of Search ..... 166/353, 352, 354, 366, 166/355, 311

[56] References Cited

U.S. PATENT DOCUMENTS

| | | | |
|---|---|---|---|
| 3,545,215 | 12/1970 | Burrus | 405/188 |
| 4,270,611 | 6/1981 | Arnaudeau et al. | 166/344 |
| 4,339,002 | 7/1982 | Gibbs | 166/366 |
| 4,967,843 | 11/1990 | Corteville et al. | 166/366 |
| 4,972,907 | 11/1990 | Sellars, Jr. | 166/354 X |

FOREIGN PATENT DOCUMENTS

| | | |
|---|---|---|
| 0310506 | 4/1989 | European Pat. Off. . |
| 2333139 | 6/1977 | France . |
| 2413536 | 7/1979 | France . |
| 1594284 | 7/1981 | United Kingdom . |
| 2157749 | 10/1985 | United Kingdom . |
| 2182083 | 5/1987 | United Kingdom . |
| 2191229 | 12/1987 | United Kingdom . |
| 2165875 | 5/1989 | United Kingdom . |

*Primary Examiner*—Stephen J. Novosad
*Attorney, Agent, or Firm*—Antonelli, Terry, Stout & Kraus

[57] ABSTRACT

A method of extending the working range of a main platform installation for oil deposits at sea involves:

(1) positioning a temporary floating station at a location distance from the main platform installation and near to an oil deposit having small individual production capacity;

(2) connecting the floating station with at least one well head of said oil deposit;

(3) bringing up multi-component effluents from the at least one well head and pumping the effluents to the main platform installation;

(4) when production of the effluents from said deposit ends, removing the floating station; and then (5) repositioning the floating station at at least one other oil deposit located at a distant location from said main platform installation to work the at least one other deposit. Also a facility for carrying out this method as described.

23 Claims, 5 Drawing Sheets

INSTALLATION AND METHOD FOR THE OFFSHORE EXPLOITATION OF SMALL FIELDS

This is a continuation of application Ser. No. 07/743,762, filed Aug. 12, 1991, now U.S. Pat. No. 5,226,482.

BACKGROUND OF THE INVENTION

The present invention relates to a method and a facility designed to work small oil deposits.

The present invention in particular allows oil fields that have thus far been economically inaccessible, to be worked at less cost. This is possible due to the use of a flexible method which employs light, standardized materials and which can for low capital investment by comparison to the structures usually employed.

Floating platforms installed on the sea bed with taut-line mooring, floating production systems composed of a platform of the semi-submersible type or ships carrying the usual oil effluent separation and treatment systems are extremely expensive to produce and maintain. The discovery in recent years of oil deposits whose recoverable reserves are limited led to the consideration of a production method and system which could be amortized under economically acceptable conditions over the total quantity of effluents extracted from small deposits.

SUMMARY OF THE INVENTION

A method and a system for working such small and relatively remote deposits are the objects of the present invention.

Moreover, this invention avoids expensive removal of existing platforms when the main fields have become unworkable or less workable, by re-using these platforms to work one or more small fields located in a distance to near vicinity of the main fields.

Use is made of the facilities located on an existing main platform in the vicinity of small fields to be worked e.g. located at a distance of up to 100 km, to increase the profitability of producing in these small fields.

This is possible due to the treatment overcapacity of the facilities on the main platform when the production flow rate from the main deposit begins to abate. With the aid of a subsea pipe, the unused capacity of the main platform in used to treat the output from neighboring secondary deposits. Thus, a daily system production capacity of 5 to $30\times10^3$ bbl (0.78 to 4,77 $10^3$ $m^3$) per day is provided, while the main platform is equipped for an output on the order of 50 to $150\times10^3$ bbl (7.58 to 23.85 $10^3$ $m^3$) per day of oil.

Essentially all the treatments of the effluents coming from the marginal or secondary deposits are carried out on the main platform.

However, this economical method of working small deposits remains constrained in application by the distance between the secondary deposits and the main platform. Pressure losses in the pipes require that secondary deposits be located between 10 and 15 kilometers from the main platform unless additional pumping devices are utilized.

Thus, the working zone of secondary wells from a main platform is relatively small. Hence, the number of workable secondary wells is also small and profitability is precarious.

Moreover, most of the devices of which such systems are composed are not standardized, so that a larger number of devices is needed, each dedicated to working one type of well, and it is not possible to rotate the devices without discriminating as to the type of deposit being worked.

The goal of the present invention in to propose a new method for working at least one secondary offshore oil deposit relatively remote from a main operating platform that does not justify construction of a conventional operating platform, as well as a facility for implementation thereof.

The goal of the present invention is also to propose an installation system whose structure allows for possible recovery of the elements used once working of the deposit is completed, and allows rotation over all the small deposits in the oil field or other oil fields through standardization of this equipment.

The operating method is monitored automatically from the main platform. Thus, at least one essential function for implementing the proposed method is controlled by remote-control means.

To achieve this goal of cutting the costs of working such deposits to the greatest degree possible, the method of working marginal deposits according to the invention comprises the following steps:

(1) at least one portable system comprised of a floating station or structure and its equipment is anchored with the aid of anchoring means above or in the vicinity of producing wells communicating with one of the secondary oil deposits located in the vicinity of a main platform installation;

(2) the multi-component effluents are brought up from said one deposit to said floating structure through first transfer means;

(3) the effluents are transferred to the main platform with the aid of pumping means located on the floating structure and second transfer means, without the multi-components being separated; and (4) at the end of working of the deposit, the system is removed and transferred to another deposit to work it.

In accordance with the description of one possible embodiment of the application preferably, at least one essential control function for working the deposit is controlled by a physical submerged-transmission link connecting the main platform to the floating structure. In this way, minimal functioning of operations is reliably ensured under all circumstances.

The physical link can be multi-functional, bringing in electric power and the remote-control signals necessary for operating the various equipment items of the floating structure, monitoring system, and means necessary for operating the well.

The floating structure can be submerged at a shallow depth between two waters i.e. the floating structure may be located or arranged to float below the surface or arranged to float below the surface of the sea and still above the sea bed.

A buoy can be used as a floating structure.

The floating structure can be equipped with a porous element playing the role of a damper, or anti-pounding device, as described in French patent application FR. 90/15,749.

The anchoring means are preferably of the catenary type; which are more appropriate than anchors with tensioned lines in the operating method according to the invention.

The equipment used when the anchoring systems with vertical tensioned lines are emplaced, usually employs rigid pipes made of steel, which are difficult to recover once installed, and more expensive. The catenary systems on the other hand, use flexible lines such as lines made by Coflexip Company, for example, which are easy to recover.

The anchoring means can, for example, comprise chains, cables, or any other means having the required characteristics for an anchor normally used in catenary systems. In all cases, these means will preferably be standardized. In this way, the system can be used "universally" for various types of deposits, in particular for deposits located in a given field.

In the framework of the applications of this invention, catenary anchoring systems have adequate reliability and flexibility characteristics. In addition, they offer the advantage of using standardized, classical materials.

Another advantage which emerges from the use of catenary systems is the possibility of recovering elements which allow the floating structure to be anchored on the sea bed, which is not possible when a platform with vertical tensioned lines is used, this operation being far more cumbersome. Indeed, the anchoring points emplaced with the latter (system) are far more complex than those used in structures of the catenary type which principally employ flexible lines and removable anchors, and hence the anchoring elements can easily be recovered. Thus, this installation allows for rotating use of the system described in the present invention, i.e. the possibility of moving this system to different deposits and sites by eliminating or minimizing to the maximum degree the risks of incompatibility relative to the various deposits to be worked. In the framework of the applications of the invention, catenary systems are less expensive, more mobile and less complex than the vertical anchoring with tensioned lines.

Flexible pipes or risers can be used an the first transfer means for bringing up the multi-component effluents. The flexible risers can be supported by an intermediate element, in which case they are S-shaped. This arrangement provides freedom from vertical and horizontal movements, more commonly called pounding.

One or more pumps with at least one multiphase pump, can be used, particularly when producing oil effluents, this pump being associated with a buffer tank designed to even out their respective gas and liquid phases flow rates and each being combined with a drive device, can be used an pumping means.

An electric motor or Diesel engine with its fuel tank, or a gas turbine with its associated equipment using a gas phase produced by the wells, can be used as the drive device.

Each floating structure is disposed at a distance from the main platform, preferably between 10 and 80 kilometers and the deposits to be worked are located at depths ranging from 50 to 1000 meters and preferably from 70 to 200 meters.

Since the method according to the invention allows well effluents to be transferred to the main platform without separation of their polyphase constituents and over long distances, a compound which reduces hydrate formation or disperses hydrates can be injected into the effluents before or during transfer to the main platform installation. Suitable compounds are disclosed in U.S. Pat. No. 4,915,726.

It is also possible to equip the floating structure with a device allowing scraping, cleaning, or measuring tools to be sent through the second means for transferring the effluents to the main platform.

The present invention also relates to a system or facility allowing the method to be implemented and the various operations of which it in composed to be carried out.

This facility or installation has, in combination, a main operating platform installation equipped with appropriate and conventional production means, designed for working offshore oil deposits; at least one portable system comprised of a floating structure and its equipment, anchoring means connecting the floating support to the sea bed so that it is in the vicinity of the producing wells communicating with one of said secondary deposits, first means for transferring multi-component effluents from the deposit to the floating structure, pumping means installed on said floating structure, the pumping means allowing transfer of oil effluents, without separation of their various components and/or phases, from the floating structure to the main platform, and second transfer means ensuring transfer of effluents from the pumping means on the floating structure to the main platform.

The installation has at least one submerged-transmission physical link between the main platform and the floating structure. The physical link can be laid on the sea bed or submerged between two layers or strata of water. The physical link can be a multifunctional link coupled to the production line of the main platform. By "multifunctional" transmission line it is meant a linkage including electrical power lines, electrical lines for transmitting remote-control signals and other lines for transmitting control signals by optical fibers.

The anchoring means are preferably of the catenary type. The anchoring means may have chains or cables or any other anchoring means having the characteristics allowing anchoring of systems of the catenary type.

The anchoring means usually have anchors which, among other things, have the advantage of carrying out emplacement or removal operations with some facility.

The first means for transferring effluents may have, for example, flexible risers or pipes which may go directly from the floating structure to the sea bed or may be supported by an intermediate element, thus giving them an "S" shape which protects them from damage due to pounding from swell movements. Usually the well pressure of the well heads of the deposits to be worked will be sufficient to force the effluents up to the floating structure.

The pumping means may be composed of one or more pumps each associated with a drive device, at least one of the pumps is a multiphase pump, this pump being associated with a buffer tank designed to even out flow rates of the gas and liquid phases.

The pump drive device may be an electric motor or a Diesel engine equipped with its fuel tank o a gas turbine with associated equipment to use the gas phase produced by the wells.

The pumping means have sufficient power to allow the effluents to be transferred, without their components being separated, from the floating structure to the main platform over a distance, preferably not limited, between 35 and 80 km.

The second transfer means include a pipe line connecting the floating structure to the main platform.

The pipe line may include a flexible or rigid section and/or a partially rigid pipe section and/or flexible riser resting on the sea bed. The second transfer means may be coupled to the submersed-transmission physical link.

The floating structure can be provided with equipment allowing injection of a chemical compound allowing production of hydrates to be reduced or hydrates to be dispersed within the effluents being transferred.

The floating structure usually will also be equipped with monitoring means and means necessary for working the well.

The floating structure may be equipped with a device allowing scraping, cleaning, and/or measuring tools to be sent in the second means for transferring effluents to the main platform.

BRIEF DESCRIPTION OF THE DRAWINGS

Other characteristics and advantages of the present invention will emerge more clearly from reading the description below of a non-limiting embodiment of the invention, with reference to the attached drawing wherein.

DETAILED DESCRIPTION OF THE INVENTION

Figure 1:
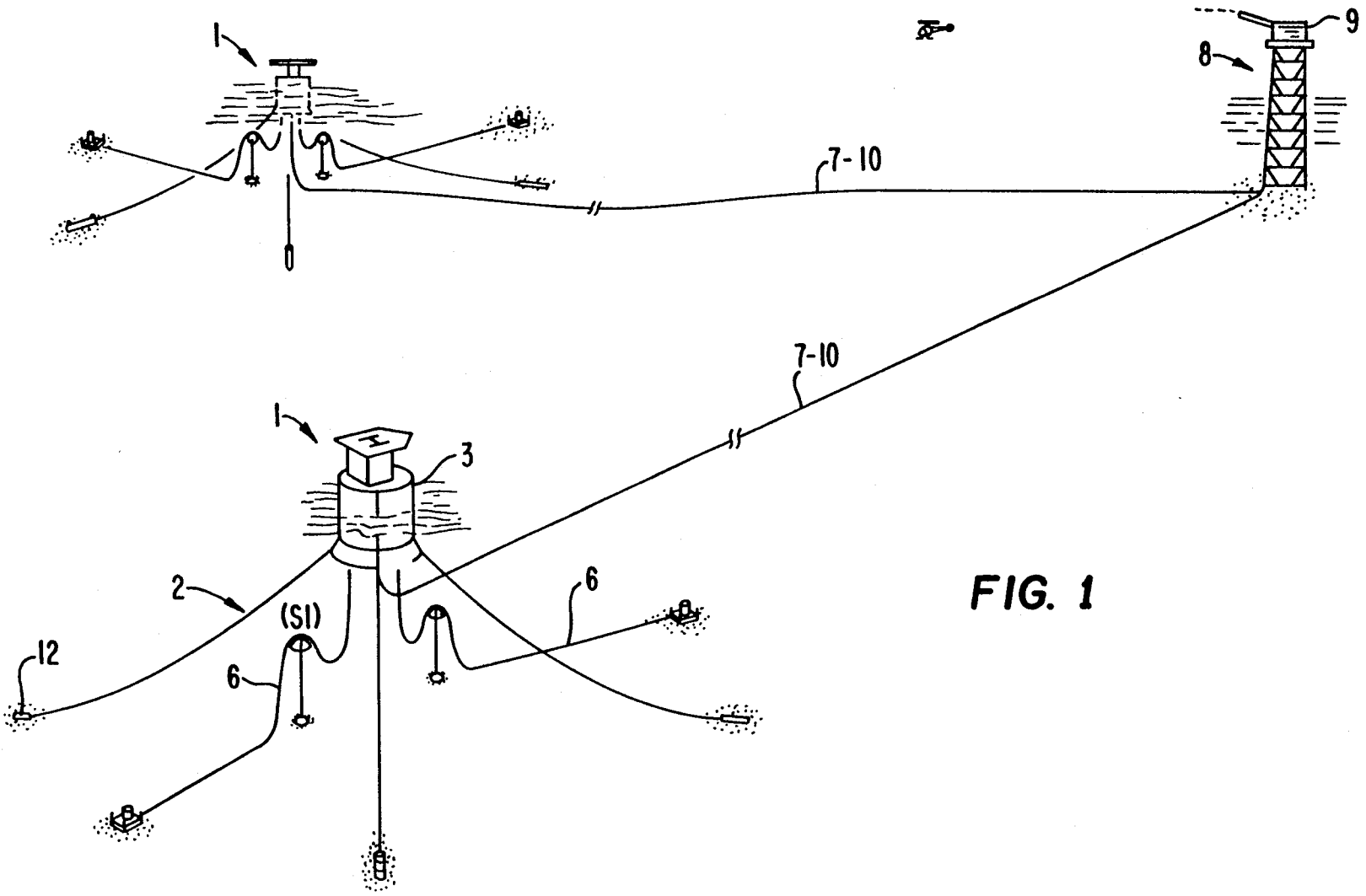
FIG. 1 is a view showing one application of the invention for equipping and working a production field made up of several deposits.
Figure 2:
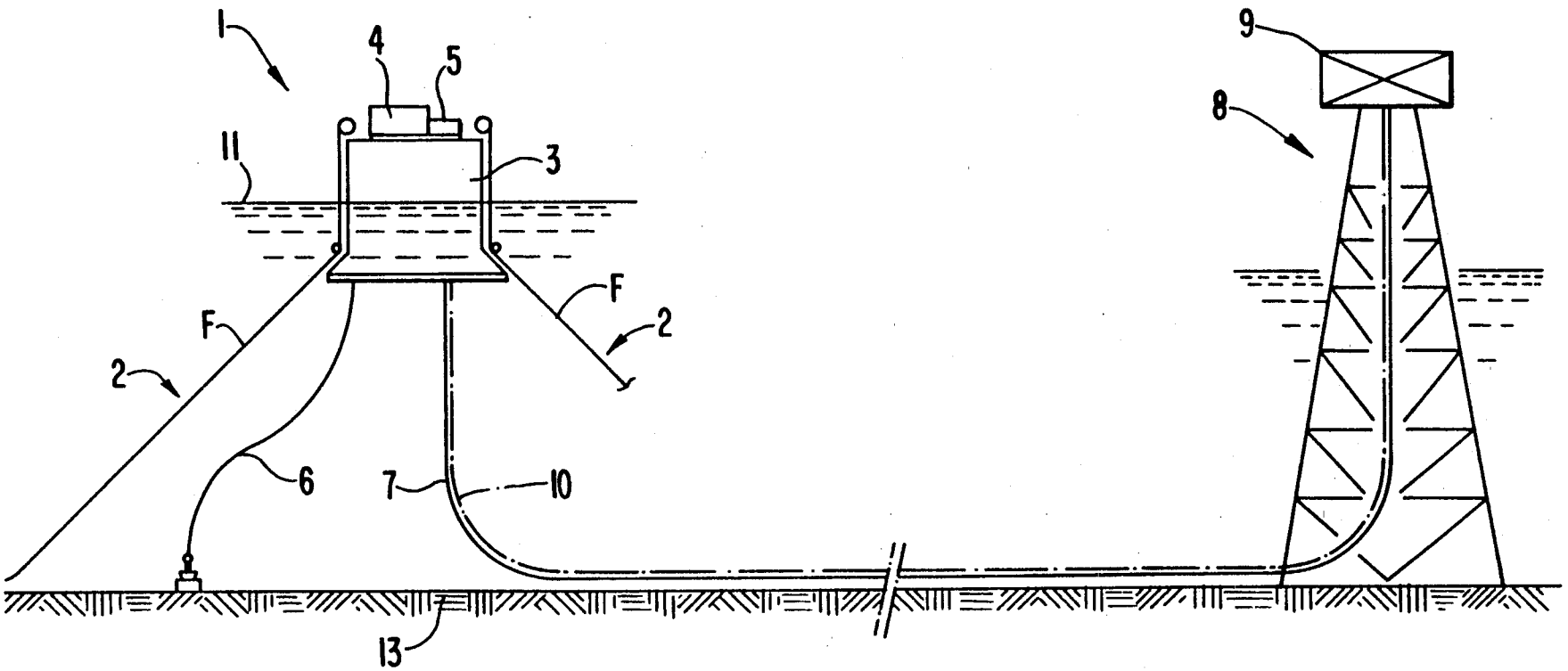
FIG. 2 is one possible embodiment of the invention in the case where a main platform equipped with an electrical power source is used with a floating station such as a buoy.

FIG. 1 shows one of the possible applications of the invention for equipping a producing field having several satellite production units 1. Anchoring means 2 are preferably of the catenary type. They have, for example, flexible lines or cables F and anchors A (FIG. 2) keeping each production unit 1 anchored above or near the well or wells that work the deposit. Each production unit 1 has a floating structure 3 such as a buoy for supporting pumping means 4, 5, which are connected to the head of each well by transfer means 6 including a riser pipe or conduit for transferring multi-component effluents to the buoy. Via second transfer means 7, including at least one pipe, pumping means 4, 5 transfer effluents from the floating structure to a main platform 8. During the working of small deposits, the usual treatment and operating equipment 9 on main platform 8 are used, schematically shown in FIG. 2. Usually, the pipe bringing up the output runs up one of the main platform legs; FIG. 2 shows it in the center to make the figure easy to read.

Initial working according to the invention of a multiple deposit comprises, for example (FIG. 2) the following stages:

1) with the aid of anchoring means 2, which means comprises at least one cable or flexible line F and an anchor A, a floating structure 3 such as a buoy is anchored above the deposit or near the producing well or wells of the deposit;

2) the oil multi-component effluents are brought up to the buoy through the first transfer means 6, for example flexible risers (the pressure existing in the deposit usually is sufficient to force effluents upwardly through the risers);

3) the effluents are transferred without separation of their components, using pumping means 4, 5 located on the buoy, to the main platform 8 through second transfer means 7, including for example, a pipe; and 4) the buoy in moved simply by pulling vertically on flexible line F, to another deposit to be worked if working of the deposit in believed no longer to be economical or if, for example, the working system is suddenly needed at another deposit.

While the deposit is being worked, various checks are made of the function of the pump and producing well. Thus, operating and measurement checks are made automatically and supply the main platform a reading, allowing it to react by operating the equipment located on the floating structure by remote control. The remote-control signals are sent, for example, from main platform 8 to floating structure 3 by a physical link 10. Physical link 10 can be multifunctional and ensure transfer of remote-control signals as well as the electrical power needed for operating the various satellite structures. (As shown in FIG. 2 the physical link often will be arranged to extend along side of the pipe or pipes of the second transfer means 7.

A buoy is used whose buoyancy characteristics are such that part of its body in immersed, the rest emerging sufficiently above the surface of the sea 11 for equipment to be installed thereon. The buoy can be equipped with a porous element playing the role of damper as described in French Application FR 90/15749 in order to minimize pounding movement due partly to swell, i.e. wave action. The technical data necessary for, determination of the buoyancy characteristics of the buoy and the pump, appropriate for the application described, can be calculated by known means.

The buoy used may be a large cylindrical buoy of the type used to moor oil tankers at sea. The typical dimensions thereof may be: diameter between 20 and 30 meters and a height between 5 and 15 meters. The use of a pencil-type buoy may also be considered.

The anchoring means can advantageously include at least one cable or flexible element F and an anchor A or any other available means allowing production unit 1 to be safely anchored, such as systems of the catenary type.

The oil effluents produced are brought up to the buoy by first transfer means such as a transfer pipe 6. This pipe 6 is flexible, such as a flexible riser, so that it can follow the local drift of the buoy. The positions of anchoring points 12 and the lengths of the anchoring chains or flexible lines F are determined such that pipe 6 in always under tension.

It is possible to have the flexible pipe supported by an intermediate element SI (FIG. 1), the pipe then being S-shaped. This arrangement decreases the effects of pounding movements on the flexible pipe.

Pumping means 4, 5 located on floating structure 3 can comprise a multiphase pump 4 and its drive device 5 having, for example, an electric motor.

A multiphase pump, for example of the type described in patents FR-2,333,139 and FR-2,471,501, in used, equipped with its buffer tank to even out the respective gas and liquid phase flows, and a drive device.

Positioning the buoy at a distance of, for example, between 10 and 80 km from an existing platform allows the buoy to be equipped with an electric motor if the main platform has electrical power; in this case the energy is brought by the link 10. If the main platform does not have electrical power, a Diesel engine is used, in which case the buoy will have a fuel storage means.

The effluents are carried, without separation of their components, by second transfer means 7 such as a pipe, for example, into which a compound such as a chemical additive for preventing formation of hydrates or for dispersing hydrates, can be injected.

This pipe is connected to on of the ends of production unit 1, the other being secured to main platform 8. Pipe 7 is partially rigid and partially flexible. It has, for example, a descending pipe section extended by a horizontal section resting on the sea bed and ending in a rising vertical pipe section, the latter being secured to main platform 8. Friction between the pipes and the sea bed limits any drift. The pipes may include J-shaped sections.

Pipe 7 and link 10 may be enclosed in a common protective outer sheath.

Figure 3A:
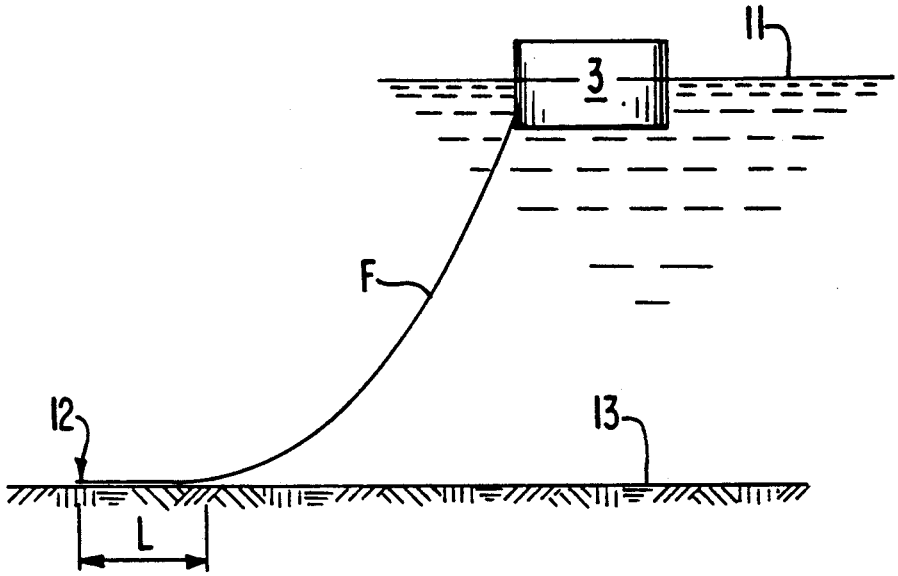
FIGS. 3A and 3B show a relatively simply emplaced and removed anchoring system, an well as an anchor.
Figure 3B:
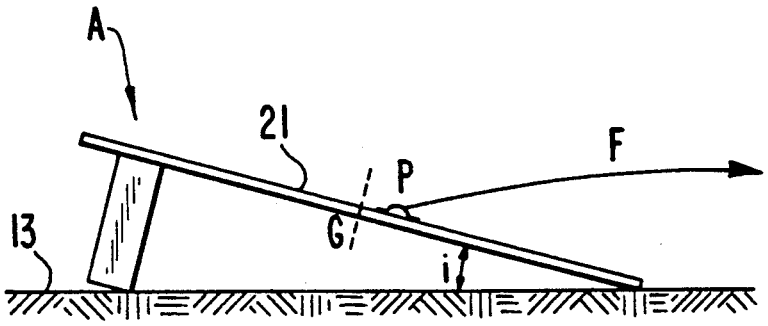

FIGS. 3A and 3B illustrate, more precisely an anchoring method employing lines used in a system of the catenary type and an anchor which can be used. The present method offers the advantage of easy emplacement and hoisting, hence rendering the system more mobile than those involving platforms with tensioned lines.

FIG. 3A shows a way of positioning such a type of anchoring line F. The tension in line F is chosen to be low enough for the line to rest an the sea bed over a length L necessary for holding an anchor A in sea bed 13 in the vicinity of anchoring point 12 and for it thus to present a catenary configuration.

An anchor such as that described in French Patent FR 2,519,310 and U.S. Pat. No. 4,688,360 can be used.

FIG. 3B illustrates a possibility of emplacing an anchor A which has at least one plate 21 to which is attached at least one anchoring line F at at least one point by a flexible link or cable that essentially introduces no moment of rotation at the attachment point P; the point of application of the pulling force on the plate is fixed and located forward of center of gravity G of the bearing surface of this plate, if one considers the direction of movement of this plate in the sea bed during its emplacement. The process of penetration of the plate into the bottom is facilitated by combining a sufficient weight for the anchor with elements arranged such a to keep the end of the anchor tilted relative to the sea bed at an angle (i) not exceeding 30 degrees. It then takes only a tug on the line F for the plate to penetrate the sea bed.

Anchoring is obtained by progressive digging-in of anchor A which slides into the bottom under the effect of the force applied by tensioned line or chain F.

To raise the anchor, one need only exert traction on anchoring line F vertically or backward, possibly with another cable attached to the rear of the anchor plate in order to make it slide in the reverse direction.

This example is in no sense limitative, as any other anchoring means having similar characteristics of ease of anchoring or removal may be used, in particular the anchoring device described in French Patent FR-2.519.310.

Figure 4:
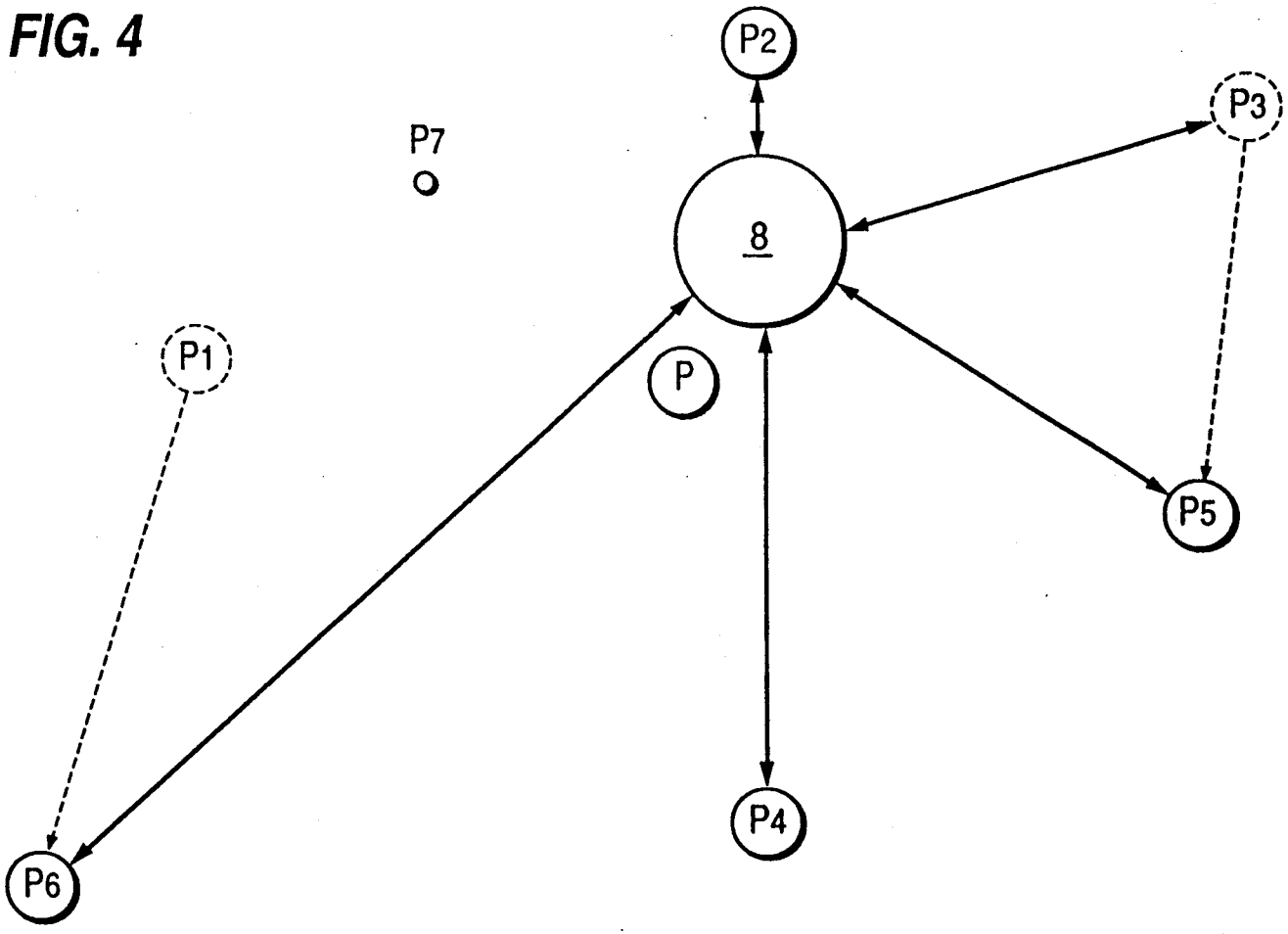
FIG. 4 describes one embodiment of the system for working an oil field having various secondary deposits.

FIG. 4 shows one of the possible embodiments of the method described above for working marginal or secondary deposits.

In the configuration shown, the oil field to be worked has several deposits $P_1$ through $P_7$ distributed in the vicinity of a main platform S. In FIG. 4, for example:

P is the main deposit;

$P_1$, $P_3$ are formerly worked deposits;

$P_2$ is a deposit 10 km away from the main platform and hence close enough to be worked without resorting to a satellite buoy; and $P_4$, $P_5$, $P_6$ are secondary deposits located respectively at distances of 50 km, 30 km, and 70 km from the main platform; (In this type of configuration, the deposits are equipped with satellite buoys for treatment. The distances cited are provided as an indication to show one of the deposit positioning options relative to the main platform); and $P_7$ is a well discovered and not yet worked.

The operating system may be the following.

At time TO, only the main deposit P in being worked. The treatment capacities C of the main platform are fully used.

When the output of the main well begins to abate, a part d of the treatment capacity C of the platform becomes idle. The treatment capacity in use on the main platform is hence: C−d.

Working of wells $P_1$ to $P_4$ then begins. The treatment capacity of the platform in use is then:

$$Ct=C-d+CP_1+CP_2+CP_3+CP_4$$

where CPi (i=1 to 4) are the production capacities of the platform necessary for working wells Pi (i=1 to 4).

At TO+t2, the output of well $P_3$ in close to zero. The satellite buoy at this deposit is then disconnected and moved to well $P_5$.

At TO+t3, the output of well $P_1$ fails to zero and in the same way, the satellite buoy at this well is moved to $P_6$, thus allowing the well to be worked.

This implementation of the device in only one particular example of the possibilities offered by the device according to the invention for operating at least one deposit located in the vicinity of an equipped main platform. Of course, the movements of the satellite buoys from one well to another are effected such as to take into account the lengths of the pipes and to move already -installed pipes as little an possible.

The use of flexibles, i.e. flexible hoses or pipes, such as those made by the Coflexip Company allows the length of pipe to be easily adapted by cutting or joining various sections to achieve the necessary length.

Figure 5:
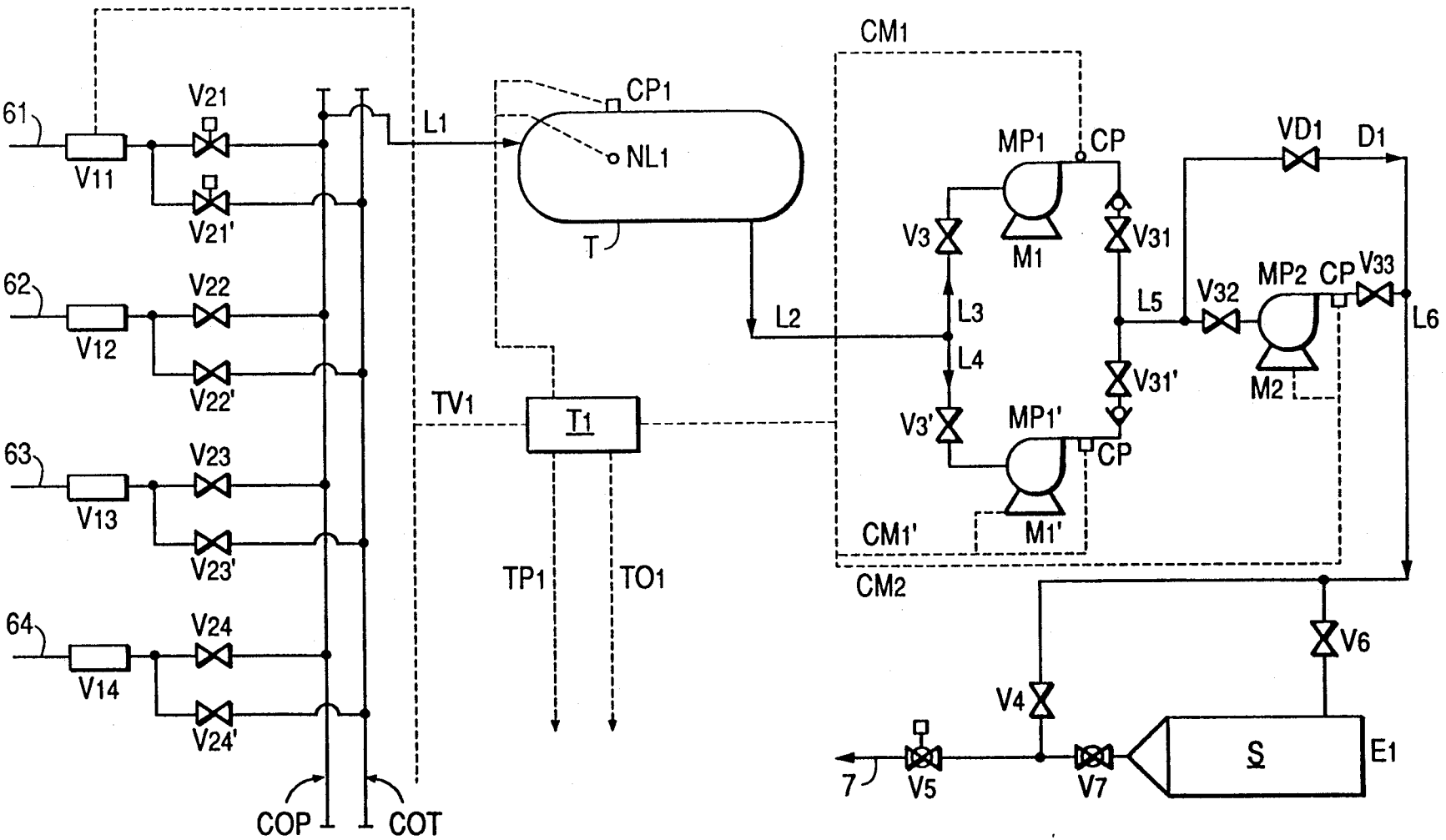
FIG. 5 shows one variant embodiment of the invention in the case where the floating structure in equipped with control means and means necessary for working the oil deposits.

FIG. 5 schematically illustrates an output routing and control system which implements the use of several multiphase pumps on a floating structure such as an satellite buoy. With reference to FIG. 5, four pumps are operated, whereby the multiphase fluid or effluent to be transferred arrives from several wellheads, via pipes 61, 62, 63, 64.

The systems bringing effluent from the well to the floating structure are identical for all the wells. Pipe 61, for example, is connected by a safety valve $V_{11}$ controlled automatically or manually. Two remote-controlled valves $V_{21}$ and $V_{21}'$ allow the effluent to be routed either to an output collector COP or to a test collector COT.

The safety valves associated with pipes 62 through 64 are designated $V_{12}$, $V_{13}$, $V_{14}$, respectively. Likewise, the pairs of valves for pipes 62 to 64, analogous to the above pair $V_{21}$, $V_{21}'$, are designated $V_{22}$, $V_{22}'$, $V_{23}$, $V_{23}'$, $V_{24}$, $V_{24}'$.

All the effluents coming from the various wells are collected in output collector COP, with valves $V_{21}$, $V_{22}$, $V_{23}$, $V_{24}$ being open and valves $V_{21}'$, $V_{22}'$, $V_{23}'$, $V_{24}'$ being closed.

All the effluent in then sent to a buffer reservoir T via a pipe $L_1$. The multiphase fluid of the effluent regulated by passage into buffer reservoir T are then transmitted through a pipe $L_2$ to a first pumping stage. In this example, this first pumping stage has two pumps $MP_1$ and $MP_1'$ and the effluent reaches them through pipes $L_3$ and $L_4$. The first pumping stage can be comprised of several pumps connected in parallel. The parallel arrangement is a particular case, appropriate when the total output flow is too great to be sent through a single pump.

The number of pumping stages and the number of pumps per stage depends on each particular application case, and more precisely on the pressure rise to be affected and the mass flow ratios and volume ratios of the various phases to be pumped.

By passage into this first stage, the pressure of each of the parts of the multiphase effluent is increased.

The outputs of pumps $MP_1$, $MP_1'$ of the first stage communicate via valves $V_{31}$, $V_{31}'$ with another pipe $L_5$ which in connected through a valve $V_{32}$ with the input of a second compression stage comprised, for example, of a pump $MP_2$. The output of the latter communicates through a valve $V_{33}$ with a pipe $L_6$. A branch $D_1$ having a valve $VD_1$ allows pipes $L_5$ and $L_6$ to communicate directly. Valves $V_{31}$ and $V_{31}'$ are provided with check valves to prevent any multiphase effluent from passing from pump $MP_1$ to pump $MP_1'$, and from pump $MP_1'$ to pump $MP_1$.

Pipe $L_6$ communicates through two valves $V_4$ and $V_5$ with pipe 7 connecting the floating structure to the main platform.

During the operation illustrated by FIG. 5, it is necessary to have appropriate monitoring and safety functions. In the present case, each pipe 61, 62, 63 and 64 from the wells is equipped with a safety valve $V_{11}$, $V_{12}$, $V_{13}$, $V_{14}$, for example an electropneumatic valves, which allow them to be shut off in the event of problems.

Buffer reservoir T is equipped with a pressure sensor $CP_1$ and a means for detecting the liquid level, $NL_1$. Depending on the liquid level and pressure values, remote-control means $T_1$ are used to control the flow from the wells, via a line $TP_1$, which can be an electric or electropneumatic line or any other line enabling information to be transmitted to the wellhead.

Remote-control means $T_1$ also make it possible, via lines CM, $CM_1'$ and $CM_2$, to control motors $M_1$, $M_1'$ and $M_2$, respectively activating pumps $MP_1$, $MP_1'$, and $MP_2$, for example, to cause them to start or stop.

If the operation of one of the pumps deteriorates, pump $MP_1$, for example, valve $V_3$ in closed in order to continue to operate the wells in a reduced mode with pump $MP_1'$ only.

If the problem is in the second stage, in the example in pump $MP_2$, valve $V_{32}$ in closed and valve $VD_1$ of branch pipe $D_1$ is opened. This allows fluid which has undergone the pressure rise in the first stage to be tapped off into pipe $L_6$.

Sensors CP located downstream of tho pumps allow the fluid effluent pressure to be monitored after passage into the pump and hence provide information on the operation of each of the pumps.

The method described above also allows the various characteristics of the fluid effluents coming from the wells to be checked occasionally; for example, the total flow rate of effluent produced by the well and the various phases of which the effluent is composed. For example, for each well, the flow rates of the gas, water, and oil in the effluent can be measured, the pressure curve plotted as a function of the flow rate, and the output regulated as a function of this information by the nozzles on the wellheads.

To run these checks, use is made for example of a boat equipped with a test separator of the type used in drilling systems and a line by which a connection is made to test collector COT. During this operation, valves $V_{21}$, $V_{22}$, $V_{23}$, and $V_{24}$ are closed, and $V_{21}'$, $V_{22}'$, $V_{23}'$, and $V_{24}'$ are opened on command by the operator through lines $TV_1$ and $TO_1$.

The method also allows injecting a compound such as a chemical additive for preventing hydrate formation during effluent transfer or reducing the accumulation of hydrates into a dispersed form to facilitate transfer of the effluent from the satellite to the main platform. Also it will be appreciated that sand and other particulate solid matter may be present in the fluid effluents coming from the well heads, such matter is usually admixed sufficiently with the fluid effluents to be conveyed through the satellite system to the main platform. However, if the amount of such particulate matter is too great to remain dispersed in the fluid effluent then appropriate filters may, notably, be installed on the floating structure.

Another possibility offered by the method is to allow cleaning of pipe 7 whereby the effluent is conveyed from the floating structure to main platform 9, which allows any deposits impeding circulation of fluid effluents in the pipe such as paraffins, etc. to be removed.

During this operation, through an inlet $E_1$ of airlock S, a means is introduced for scraping the pipe, for example a scraper normally used in oil fields, valve $V_4$ in closed, and valves $V_6$ and $V_7$ are opened. The fluid effluent then pushes the scraper into pipe 7.

It is understood that it will not be a departure from the framework of the invention if certain modifications were made in the equipment of the system: as a nonlimitative example, if the buoy were a large, equipped barge.

At least one of the multiphase pumps described above may be of the helical type. This type of pump in particularly well suited for this type of application. In fact, the pump can be used over a fairly broad GLR (gas liquid ratio) range, which decreases the facilities that need to be placed on the buoy. In particular, such a pump avoids having to separate the effluent into several phases so that a single pipe is used to transfer the components between the buoy and the main platform.

When working gas deposits, the pumping system may call on a single pump or compressor, and its drive device.

The drive device may be a Diesel engine with its fuel tank, a gas turbine with its associated equipment, or others.

It will be appreciated that with a well located close to the main platform, e.g. 5 km, the oil effluent may be sent directly to this platform in the case where the oil deposit has sufficient natural pressure.

Recovery of oil being easier and quicker using the method of the present invention, working of marginal oil deposits within the range of 10 to 20 or 30 km, for example, becomes profitable. An advantage also emerging from transferring of effluents without the different phases being separated is the possible recovery of the gaseous phase on the main platform for producing energy or for keeping under pressure a main oil deposit (i.e., a deposit close to the main platform) which is getting depleted or else the possible transfer of the recovered gas to a coastal facsility for distribution if the main platform is connected to a pipe network.

It would not be a departure from the framework of the invention if the floating structure and its pumping equipment were connected to these wells located at a relatively short distance from a main installation when the natural pressure of the wells became inadequate. In this same way, the working life of an oil deposit in prolonged.

The method can also be employed temporarily to test the producing capacities of a deposit that is still poorly known. In this case, a test is performed with the aid of the method described above and the floating structure is replaced, if the test is positive, by a working installation better matching the capacity of the deposit. This avoids investing in an expensive fixed platform when the production capacities of the deposit are uncertain.

The floating structure may also comprise a means for injecting chemical additives to protect the pipes from corrosion.

The floating structure for working the deposit may be equipped with all the means necessary for working or testing the well with no change to the basin of the system proposed. In addition, the usual equipment of floating units can be emplaced, namely a manifold allowing the outputs from various wells to be grouped together.

The floating structure may have an emergency shelter and possibly a light deck for helicopters.

Thus, the present invention avoids the use of amphibious ("submarinized" or immersed structures) and hence costly pumping means.

It will also not be a departure from the scope of the invention if, instead of considering the use of a main subsea platform, the output of the deposits is sent to a coastal facility having the appropriate equipment for processing the multi-component fluid effluent. Recovery of crude oil is also facilitated and increased.

It is preferable to stabilize each floating structure by anchoring means of the catenary type for their ease of use. In certain cases, however, tensioned lines can be used if circumstances so lend themselves. Also, for safety, reliability and other reasons, it is preferable to use a physical link between the main platform and each floating structure. This would not however exclude the use of any other sufficiently safe linking means within the framework of the operations in view.

The invention also includes any other modification within the scope of the individual skilled in the art.

What is claimed is:

1. A method of extending the working range of a main platform installation for oil deposits at sea, which comprises:

(1) positioning a temporary floating station at a location distance from said main platform installation and near to an oil deposit having small individual production capacity;

(2) connecting the floating station with at least one well head of said oil deposit;

(3) bringing up multi-component effluents from the at least one well head and pumping the effluents to the main platform installation;

(4) when production of the effluents from said deposit ends, removing the floating station; and then (5) repositioning the floating station at at least one other oil deposit located at a distant location from said main platform installation to work the at least one other deposit.

2. A method according to claim 1, wherein the floating platform is positioned near to the at least one well head by a flexible anchoring means which is attached to the floating station and which extends as a catenary to a portable anchor on the sea bed.

3. A method according to claim 1, wherein the floating platform is positioned near the at least one well head when primary well heads surrounding and closely adjacent to the main platform installation have decreased oil production sufficiently to enable the main platform installation to process additional multi-components effluents from the at least one well head.

4. A facility designed for working oil deposits under a layer of water (or offshore) and communicating with the bottom of the layer of water via producing wells, which comprises in combination, a main working platform equipped with production means designed to work offshore deposits, at least one floating structure, anchoring means to connect the floating structure to the sea bed so that the structure is in the vicinity of producing wells communicating with one of said deposits, first transfer means for allowing the transfer of multi-component effluents from at least one production well to the floating structure, pumping means allowing transfer of oil effluents without separation of their various components or phases on said structure, and second transfer means for transferring the effluents from the pumping means on the floating structure to the main platform.

5. A facility according to claim 1, further comprising at least one physical submerged-transmission link between the main platform and the floating structure.

6. A facility according to claim 1, wherein the physical link is submerged and positioned between two layers of water.

7. A facility according to claim 1, wherein the anchoring means is of the catenary type.

8. A facility according to claim 5, wherein the physical link comprises a multifunctional link joined to a production line of said second transfer means.

9. A facility according to claim 8, wherein the anchoring means comprises a catenary type.

10. A facility according to claim 4, wherein the first transfer means comprises at least one flexible pipe.

11. A facility according to claim 10, wherein the flexible pipes comprises risers directly connecting the floating structure to well heads on the sea bed.

12. A facility according to claim 11, wherein the flexible risers are supported by an intermediate support element between said producing wells and the floating structure to attenuate the effects of pounding of the swell on the risers.

13. A facility according to claim 4, wherein the pumping means comprises at least one multiphase pump associated with a buffer tank designed to even out the respective flow ratio of gas and liquid phases of the effluent.

14. A facility according to claim 13, wherein said drive device comprises an electric motor or a Diesel engine equipped with a fuel tank or a gas turbine with its equipment with its associated equipment using a gas phase produced by the wells.

15. A facility according to claim 13, wherein each pump has sufficient power to transfer the output of effluents without separation of their various components to the main platform located at most 80 kilometers away from said floating structure, preferably located between 10 and 80 kilometers away.

16. A facility according to claim 4, wherein said second transfer means comprises a pipe connecting said floating structure to the main platform.

17. A facility according to claim 16, wherein said pipe includes a flexible or rigid pipe, or partially rigid pipe, resting on the sea bed.

18. A facility according to claim 4, wherein the floating structure is equipped with control means and means necessary for working oil deposits.

19. A facility according to claim 4, wherein the floating structure is equipped with means for injecting a compound designed to prevent formation of hydrates or to disperse hydrates within said effluents.

20. A facility according to claim 4, wherein the floating structure is equipped with scraper means for cleaning the second transfer means.

21. A facility according to claim 5, wherein the physical link is laid on the sea bed.

22. A facility according to claim 4, wherein one or more pumps and their associated drive devices are used as pumping means.

23. A facility according to claim 22, wherein the pumping means comprises at least one multiphase pump associated with a rubber tank designed to even out the respective flow ratio of gas and liquid phases of the effluent.

* * * * *